US007018307B2

(12) United States Patent
Ohira

(10) Patent No.: US 7,018,307 B2
(45) Date of Patent: Mar. 28, 2006

(54) METHOD FOR MARKING GOLF BALL AND GOLF BALL

(75) Inventor: Takashi Ohira, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 83 days.

(21) Appl. No.: 10/859,609

(22) Filed: Jun. 3, 2004

(65) Prior Publication Data

US 2005/0272531 A1 Dec. 8, 2005

(51) Int. Cl.
*A63B 37/12* (2006.01)

(52) U.S. Cl. ..... 473/378; 473/351; 101/33; 101/34

(58) Field of Classification Search ..... 473/351, 473/378; 101/33, 34, 492, 493
See application file for complete search history.

(56) References Cited

U.S. PATENT DOCUMENTS

| | | | | |
|---|---|---|---|---|
| 5,427,378 | A | 6/1995 | Murphy | |
| 6,540,624 | B1 * | 4/2003 | Isogawa | 473/371 |
| 6,554,723 | B1 | 4/2003 | Kametani et al. | |
| 6,558,277 | B1 * | 5/2003 | Ohira et al. | 473/378 |
| 6,748,867 | B1 * | 6/2004 | Kametani et al. | 101/491 |
| 6,766,739 | B1 * | 7/2004 | Isogawa et al. | 101/333 |
| 2002/0045493 | A1 * | 4/2002 | Isogawa et al. | 473/351 |
| 2003/0100385 | A1 * | 5/2003 | Fushihara et al. | 473/371 |
| 2003/0148828 | A1 * | 8/2003 | Isogawa | 473/378 |
| 2003/0221574 | A1 * | 12/2003 | Kametani et al. | 101/483 |
| 2004/0097302 | A1 * | 5/2004 | Isogawa et al. | 473/378 |
| 2004/0142765 | A1 * | 7/2004 | Kennedy et al. | 473/351 |

FOREIGN PATENT DOCUMENTS

| | | |
|---|---|---|
| JP | 11-114093 A | 4/1999 |

* cited by examiner

*Primary Examiner*—Raeann Gorden
(74) *Attorney, Agent, or Firm*—Sughrue Mion, PLLC

(57) ABSTRACT

The invention provides a golf ball marking method of marking the surface of a golf ball with a character, pattern or the like by a direct or indirect printing technique, comprising applying a marking layer onto the ball surface for marking, the marking layer being of a two-layer structure consisting of a lower layer of a composition containing a color pigment in a lower layer ink medium and an upper layer which is formed on the lower layer from a composition containing a metal powder in an upper layer ink medium and which is transparent or translucent and has brilliance, and adjusting the content of the metal powder and the thickness of the upper layer such that the relation of the content (wt %) of the metal powder relative to the upper layer ink medium solids to the thickness (μm) of the upper layer may satisfy the inequality: $1 \leqq$[metal powder content (wt %)]×[upper layer thickness (μm)]$\leqq 10$. When it is desired to impart brilliance in a dark color such as black, the dark color is improved in sharpness and reproducibility.

9 Claims, 2 Drawing Sheets

METHOD FOR MARKING GOLF BALL AND GOLF BALL

BACKGROUND OF THE INVENTION

This invention relates to a golf ball marking method for marking the surface of a golf ball with a character, pattern or the like and a golf ball resulting from the method. More particularly, it relates to a golf ball marking method in which even when it is desired to impart brilliance in a dark color such as black, the dark color is improved in sharpness and reproducibility, and a golf ball resulting from the method.

In general, the surface of golf balls is marked with characters, numerals, and patterns such as trade names and logo marks by a direct or indirect printing technique. Such marks include those marks which serve to impart sharpness and an aesthetic look to the outer appearance of balls when given brilliance. Proposed as means for providing brilliance is a technique of previously incorporating a metal powder such as aluminum or copper powder in ink and using the ink to apply metallic tone marks to golf balls.

However, if it is desired to impart brilliance in a dark color such as black to the golf ball surface, there is a tendency that the dark color lacks sharpness and reproducibility.

Also, JP-A 11-114093 describes a golf ball on which marks are formed using a transfer film having an ink layer containing a pigment and a metal powder. U.S. Pat. No. 6,558,277 discloses a golf ball having the color flop effect that the color sharply changes with the viewing direction, and U.S. Pat. No. 5,427,378 discloses a golf ball having a resinous cover on a surface of which a plurality of light reflective particles are dispersed.

These golf balls, however, have the problem that when it is desired to impart brilliance in a dark color such as black, the dark color is still insufficient in sharpness and reproducibility.

SUMMARY OF THE INVENTION

An object of the present invention, which has been made under the above-discussed circumstances, is to provide a golf ball marking method in which when it is desired to impart brilliance in a dark color such as black, the dark color is improved in sharpness and reproducibility, and a golf ball resulting from the method.

In an attempt to divide a marking layer to be applied to the golf ball surface into two layers, use an ink layer for developing the desired color as the lower layer, and use a transparent ink layer for imparting brilliance as the upper layer so as to enhance the outer appearance of the ball and especially, impart brilliance in a dark color such as black, the inventor made extensive investigations to improve the sharpness and reproducibility of the dark color. As a result, the inventor has discovered a golf ball marking method characterized in that the upper layer is a transparent or translucent layer which is formed of a composition containing a metal powder, typically aluminum powder, in an ink medium and is endowed with brilliance, and that the content of the metal powder and the thickness of the upper layer are adjusted such that the relation of the content (wt %) of the metal powder relative to the solids of the upper layer ink medium to the thickness (μm) of the upper layer may satisfy the inequality: $1 \leqq$[metal powder content (wt %)]×[upper layer thickness (μm)]$\leqq 10$.

Accordingly, the present invention provides a golf ball marking method and a golf ball, which are defined below.

[1] A golf ball marking method of marking the surface of a golf ball with a character, pattern or the like by a direct or indirect printing technique, characterized by the steps of:

applying a marking layer onto the ball surface for marking, the marking layer being of a two-layer structure consisting of a lower layer of a composition containing a color pigment in a lower layer ink medium and an upper layer which is formed on the lower layer from a composition containing a metal powder in an upper layer ink medium and which is transparent or translucent and has brilliance, and adjusting the content of the metal powder and the thickness of the upper layer such that the relation of the content (wt %) of the metal powder relative to the solids of the upper layer ink medium to the thickness (μm) of the upper layer may satisfy the inequality: $1 \leqq$[metal powder content (wt %)]×[upper layer thickness (μm)]$\leqq 10$.

[2] The golf ball marking method of [1], wherein the character, pattern or the like is marked by a pad printing technique.

[3] The golf ball marking method of [1], wherein the character, pattern or the like is marked by thermal transfer using a transfer member.

[4] The golf ball marking method of [3], wherein a mode of printing the character, pattern or the like on the transfer member is silk screen printing.

[5] The golf ball marking method of [4], wherein the silk screen printing uses a screen having a ruling of 200 to 300 lines.

[6] The golf ball marking method of [1], wherein the metal powder has an average particle size of up to 20 μm.

[7] The golf ball marking method of [1], wherein the metal powder is an aluminum powder.

[8] The golf ball marking method of [3], wherein a mode of printing the character, pattern or the like on the transfer member is gravure printing.

[9] A golf ball characterized in that a marking layer is formed on the golf ball surface by the method of any one of [1] to [8].

DETAILED DESCRIPTION OF THE INVENTION

Figure 1A:
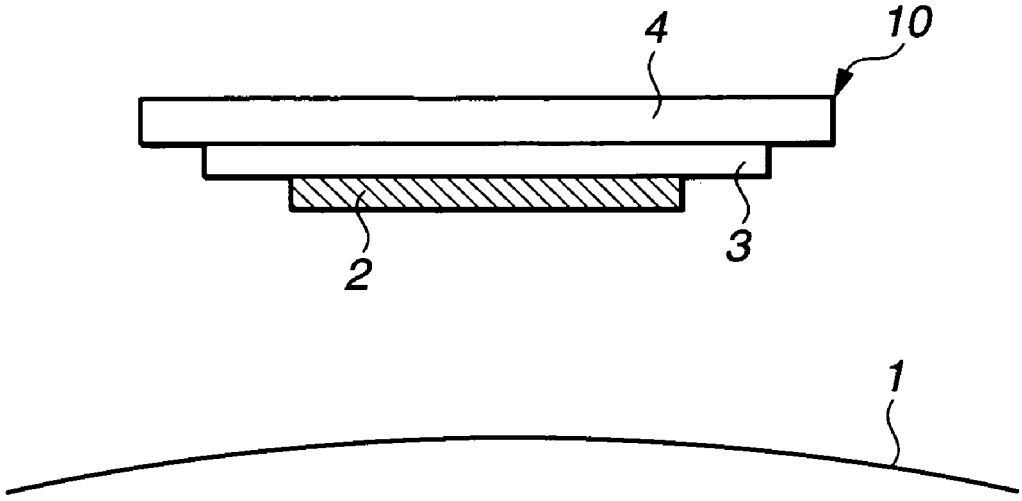
FIG. 1 illustrates a gold ball marking method according to one embodiment of the invention.

The golf ball marking method of the invention intends to enhance the outer appearance of marking by dividing a marking layer that represents a character, pattern or the like on the golf ball surface into upper and lower layers.

The marking layer is of a two-layer structure consisting of a lower layer of a composition containing a color pigment in a lower layer ink medium and an upper layer which is formed on the lower layer from a composition containing a metal powder in an upper layer ink medium for imparting brilliance and which is transparent or translucent.

The upper layer or lower layer ink medium is an intermediate which is available in the process of preparing printing ink and has a full printing function as ink once it is colored. The ink medium is generally composed of an ink resin, a plasticizer, fillers (such as extender pigments and fillers), a solvent and the like.

The ink media for the upper and lower layers may be the same or different although identical media are desired for the adhesion between layers.

The ink resins which can be used herein include vinyl chloride-vinyl acetate copolymers, vinyl chloride-vinyl acetate-vinyl alcohol copolymers, urethane resins, polyester resins, polyethylene imine resins, polyamide resins, acrylic resins, chlorinated polyolefin resins, and nitrocellulose. It is preferred that the ink resins be colorless and transparent because they do not reduce the color effect that develops when a pigment is admixed.

The plasticizers which can be used herein include dibutyl phthalate, dioctyl phthalate, dioctyl adipate, dioctyl azelate, triethyl citrate, tributyl acetylcitrate, dibutyl sebacate, and dioctyl sebacate.

The extender pigments which can be used herein include calcium carbonate, titanium oxide, barium sulfate, alumina white, zinc oxide, clay and powdered silica.

In the invention, from the standpoint of imparting brilliance, a metal powder is incorporated in the ink medium. The preferred form of metal powder is a metal paste having metal powder dispersed in a solvent. The metal powder preferably has an average particle size of up to 20 μm, more preferably up to 15 μm. An average particle size larger than the range is inconvenient in that the image quality must be accordingly reduced.

As to the type of metal powder, use may be made of aluminum, chromium, cobalt, steel, silver, gold, copper, nickel and various alloys of any of the foregoing metals. Of these, use of aluminum is preferred.

The color pigment which can be used in the lower layer in the inventive method may be selected from materials well known as pigments having chromatic colors. Such pigments may be either organic or inorganic. Examples include carbon black, graphite, black iron, red lead, red iron oxide, ultramarine, Prussian blue, Lithol Red B, Brilliant Scarlet G, Pigment Scarlet 3B, Brilliant Carmine 6B, Lake Red C, Lake Red D, Permanent Red 4R, Bordeaux 5B, Bordeaux 10B, Para Red, Watchung Red, Benzidine Orange, BON Maroon L, BON Maroon M, Brilliant Scarlet, Vermilion Red, Phthalocyanine Blue, Phthalocyanine Green, Fast Sky Blue, Aniline Black, zinc white, white lead, zinc yellow, Dis-Azo Yellow, barium sulfate, Fast Yellow G, Fast Yellow 10G, etc., which may be used alone or in admixture of two or more.

In the marking method of the invention, the effect of the invention becomes prominent when pigments of dark colors such as black are used rather than pigments of light colors. Specifically, the effect of the invention becomes prominent when pigments toned to an L value of up to 60 as expressed by Munssel notation system (JIS Z8721) are used.

In the invention, the content of the metal powder and the thickness of the upper layer are adjusted such that the relation of the content (wt %) of the metal powder relative to the solids of the ink medium to the thickness (μm) of the upper layer may satisfy the inequality: $1 \leqq$[metal powder content (wt %)]×[upper layer thickness (μm)]$\leqq 10$.

The above inequality has a technical significance of exerting in synergism the effect of imparting brilliance to the ball outer appearance and the effect of improving color reproducibility. In the above inequality, the preferred upper limit is 9, and more preferably 6. The preferred lower limit is 2. If the value is less than 1, the effect of imparting brilliance to marking is not fully exerted. A value in excess of 10 may allow the metal powder such as aluminum powder to exert a hiding effect so that the color of lower layer ink medium may be canceled by the color of metal.

The thickness of the upper layer is desirably adjusted to a range of 1 to 12 μm. If the upper layer is thicker than the range, the marking layer printed on the ball surface becomes thicker as a whole, which may detract from ball functions such as impact durability.

The technique of marking the golf ball surface with characters, patterns or the like may be any of ordinary techniques commonly used in the marking of golf balls. For example, direct printing techniques based on pad printing, and indirect printing techniques such as a transfer technique of using an all "solid" transfer film and imprinting with a stamp, and a thermal transfer technique of printing through thermal transfer. The type of marks, the marking position, the number of marks and the like are not particularly limited. Characters, numerals, and patterns such as trade names and logo marks may be marked at any desired position on the golf ball surface.

For example, when a mark is printed on the golf ball surface using a transfer film, an ink composition which is previously prepared is printed on a polypropylene film or biaxially oriented polypropylene film or a laminate foil thereof with glassine paper, commonly used in the art, to form a transfer film. The technique of forming a marking layer representative of a predetermined pattern on the base film is preferably screen printing or gravure printing. When screen printing is employed, it is desirable to use a screen having a ruling of 200 to 300 lines.

The mark can be transferred to a golf ball by laying the transfer ink layer on the position of the golf ball where the mark is to be formed, pressing from the base film side while heating at about 90–150° C. or about 150–180° C., thereafter peeling the base film. It is noted that a clear coat may be applied onto the thus transferred mark, if desired.

The thickness of the marking layer used herein is desirably previously adjusted so that it may have a thickness of 2 to 16 μm, especially 4 to 12 μm when transferred or otherwise applied onto the ball.

The golf balls used in the invention are not particularly limited with respect to their structure, material, manufacturing process and the like. The balls can be manufactured by using well-known materials and conventional molding. The ball structures may be either wound golf balls or one- or two-piece solid golf balls or multi-piece solid golf balls having a cover of two or more layers.

EXAMPLE

Examples and Comparative Examples are given below for illustrating the invention although the invention is not limited to these Examples.

In each of Examples 1 to 6 and Comparative Examples 1 to 9, a transfer film 10 was prepared as shown in FIG. 1A, by using a biaxially oriented polypropylene film 4 of 33 μm thick as a base film, laminating a marking lower layer 2 of a black ink composition of the formulation shown in Table 1 and a marking upper layer 3 of the formulation shown in Table 2 in combination on the base film (transfer foil) 4 while utilizing a silk screen printing or gravure printing technique.

Figure 1B:
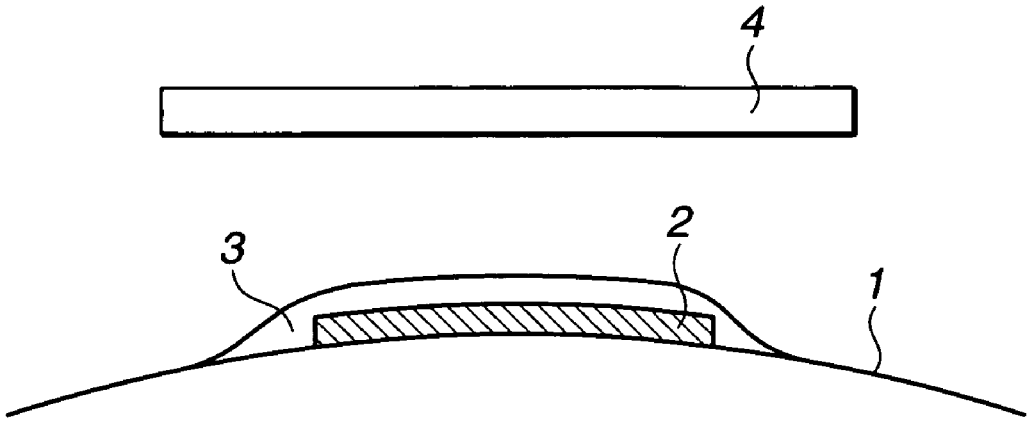
Figure 2:
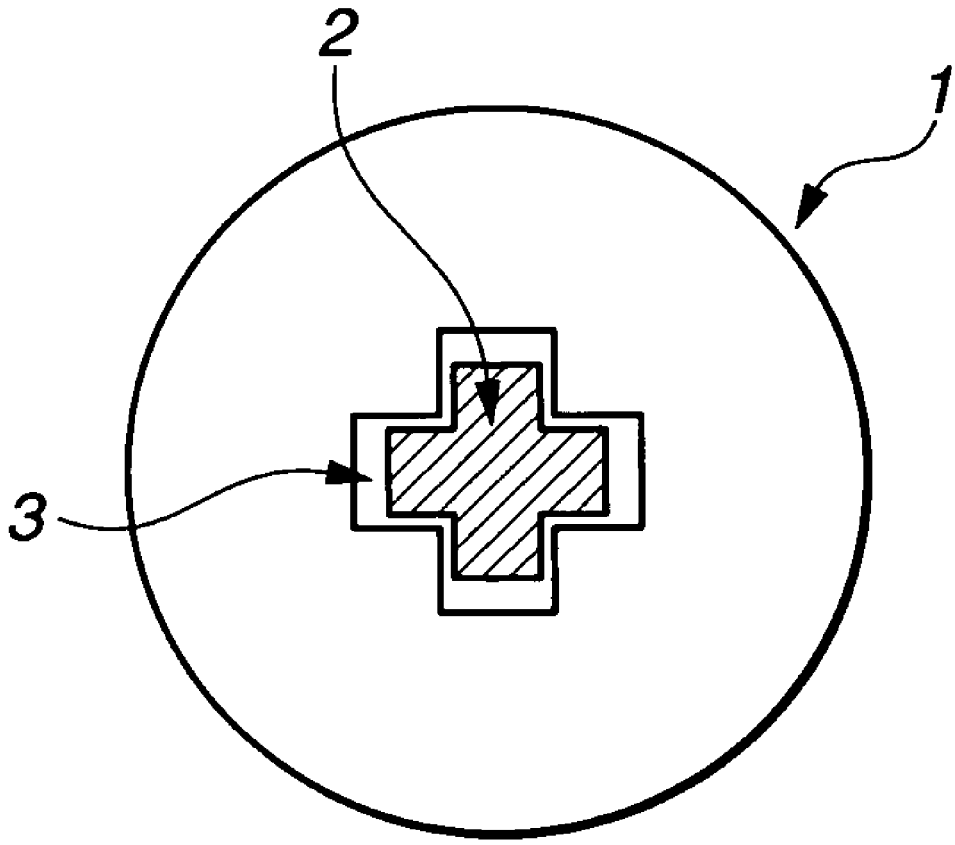
FIG. 2 is a plan view showing a ball surface portion where a mark is applied.

Separately, two-piece balls comprising a core of crosslinked rubber based on polybutadiene rubber which is enclosed with an ionomer resin-based cover material having a Shore D hardness of 65 to a thickness of about 2 mm were furnished as the golf balls to which the mark was to be transferred. It is noted that the balls on the surface were administered plasma surface treatment. As shown in FIG. 1B, using the transfer film 10 of the construction reported under Examples 1–6 (Table 3) and Comparative Examples 1–9 (Tables 4 and 5), a generally crisscross shaped mark 2 having length and width sizes of about 12 mm was thermally transferred to the treated surface 1 of the golf ball. The marked state is shown in FIG. 2. The transfer temperature was 140° C. and a silicone pad was pressed for one second. Example 7 used direct printing by a pad printing technique. Specifically, the lower layer ink medium "a" was printed on the ball surface by the pad technique, and the upper layer ink medium "C" was printed thereon by the pad technique.

The ball thus marked by the method of each example was evaluated by the following tests.

Brilliance

In an outdoor environment under sunlight, the marked portion was visually observed.

⊙: full metallic luster by light reflection

○: metallic luster by light reflection

Δ: insufficient light reflection, insufficient metallic luster

X: little or no light reflection, no luster

Reproduction of Lower Layer Color

In a room under white illumination, the marked portion was visually observed.

⊙: lower layer color is reproduced intact

○: lower layer color is almost reproduced

Δ: some mixing of upper layer color with lower layer color (white looking)

X: different color from lower layer color (metal color develops predominantly)

Abrasion Test

A porcelain ball mill was charged with balls together with the sand used in the bunker in a golf course and operated for 2 hours. Thereafter, the balls were taken out, and the marked portions were visually inspected for peel and damage according to the following criterion.

⊙: no peel or damage

○: no peel or damage over an extent of at least 90% of the marked portion

Δ: no peel or damage over an extent of at least 70% of the marked portion

X: peeled or damaged over an extent of at least 30% of the marked portion

Impact Durability

Using a driver (W#1) at a head speed of 45 m/s, the golf ball marked in each example was hit toward a fabric target, which was repeated 200 times. The degree of damage on the marked portion was visually rated according to the following criterion.

⊙: no peel or damage

○: no peel or damage over an extent of at least 90% of the marked portion

Δ: no peel or damage over an extent of at least 70% of the marked portion

X: peeled or damaged over an extent of at least 30% of the marked portion

TABLE 1

| Parts by weight | | | a | b | c | d | e | f |
|---|---|---|---|---|---|---|---|---|
| Ink medium | Solids | Resin 1 | 18 | 18 | 18 | 18 | 18 | 18 |
| | | Resin 2 | 2 | 2 | 2 | 2 | 2 | 2 |
| | | Plasticizer | 15 | 15 | 15 | 15 | 15 | 15 |
| | | Extender pigment | 15 | 15 | 15 | 15 | 15 | 15 |
| | Solvent | Cyclohexane | 25 | 25 | 25 | 25 | 25 | 25 |
| | | High-boiling solvent | 25 | 25 | 25 | 25 | 25 | 25 |
| | | Total | 100 | 100 | 100 | 100 | 100 | 100 |
| Color pigment | Carbon black | | 5 | 4 | 3 | 2 | 1 | |
| | Aluminum paste | | | 8 | 16 | 24 | 32 | 40 |

TABLE 2

| Parts by weight | | | A | B | C | D | E | F | G |
|---|---|---|---|---|---|---|---|---|---|
| Ink medium | Solids | Resin 1 | 18 | 18 | 18 | 18 | 18 | 18 | 18 |
| | | Resin 2 | 2 | 2 | 2 | 2 | 2 | 2 | 2 |
| | | Plasticizer | 15 | 15 | 15 | 15 | 15 | 15 | 15 |
| | | Extender pigment | 15 | 15 | 15 | 15 | 15 | 15 | 15 |
| | Solvent | Cyclohexane | 25 | 25 | 25 | 25 | 25 | 25 | 25 |
| | | High-boiling solvent | 25 | 25 | 25 | 25 | 25 | 25 | 25 |
| | | Total | 100 | 100 | 100 | 100 | 100 | 100 | 100 |
| Color pigment | Aluminum paste | | 0.1 | 0.3 | 0.5 | 0.8 | 1.0 | 1.5 | 2.0 |
| Aluminum content (% based on solids) | | | 0.14 | 0.41 | 0.69 | 1.10 | 1.38 | 2.07 | 2.76 |

Resin 1: vinyl chloride-vinyl acetate-vinyl alcohol copolymer resin (Dow Chemical, UCAR VAGH)
Resin 2: epoxy-containing acrylic polymer (NOF Corp., Blenmer CP-30)
Plasticizer: dibutyl phthalate
Extender pigment: calcium carbonate
High-boiling solvent: selected from aromatic, ketone, ester and other solvents while confirming printability
Aluminum paste 1: heat residue 69% (Toyo Aluminum Co., Ltd., Aluminum Paste TD200T, average particle size 15 μm)

TABLE 3

| | | Example | | | | | | |
|---|---|---|---|---|---|---|---|---|
| | | 1 | 2 | 3 | 4 | 5 | 6 | 7 |
| Imprinting technique | | thermal transfer | thermal transfer | thermal transfer | thermal transfer | thermal transfer | thermal transfer | pad |
| Printing technique to transfer foil | | silk screen | silk screen | silk screen | silk screen | gravure | gravure | — |
| Ink thickness per layer (μm) | | 6 | 6 | 6 | 6 | 2 | 2 | 6 |
| Structure | Upper layer | B | C | D | E | F | G | C |
| | Lower layer | a | a | a | a | a | a | a |
| Aluminum content × upper layer thickness | | 2.46 | 4.14 | 6.60 | 8.28 | 4.14 | 5.52 | 4.14 |
| Evaluation | Brilliance | ○ | ◎ | ◎ | ◎ | ◎ | ◎ | ◎ |
| | Color (visual dark observation) | black | black | black | dark silver gray | black | black | black |
| | Reproduction of lower layer color | ◎ | ◎ | ◎ | ○ | ◎ | ◎ | ◎ |
| | Abrasion test | ◎ | ◎ | ◎ | ◎ | ◎ | ◎ | ◎ |
| | Impact durability | ◎ | ◎ | ◎ | ◎ | ◎ | ◎ | ◎ |

TABLE 4

| | | Comparative Example | | | | | |
|---|---|---|---|---|---|---|---|
| | | 1 | 2 | 3 | 4 | 5 | 6 |
| Imprinting technique | | thermal transfer | thermal transfer | thermal transfer | thermal transfer | thermal transfer | thermal transfer |
| Printing technique to transfer foil | | silk screen | silk screen | silk screen | silk screen | silk screen | silk screen |
| Ink thickness per layer (μm) | | 6 | 6 | 6 | 6 | 6 | 6 |
| Structure | Upper layer | A | F | G | — | — | — |
| | Lower layer | a | a | a | a | b | c |
| Aluminum content × upper layer thickness | | 0.84 | 12.42 | 16.56 | — | — | — |
| Evaluation | Brilliance | x | ◎ | ◎ | x | x | Δ |
| | Color (visual observation) | black | silver gray | silver | black | black | dark gray |
| | Reproduction of lower layer color | ◎ | x | x | ◎ | ◎ | Δ |
| | Abrasion test | ◎ | ◎ | ◎ | ◎ | ◎ | ○ |
| | Impact durability | ◎ | ◎ | ◎ | ◎ | ○ | ○ |

TABLE 5

| | Comparative Example | | |
|---|---|---|---|
| | 7 | 8 | 9 |
| Imprinting technique | thermal transfer | thermal transfer | thermal transfer |
| Printing technique to transfer foil | silk screen | silk screen | silk screen |
| Ink thickness per layer (μm) | 6 | 6 | 6 |
| Structure | | | |
| Upper layer | — | — | — |
| Lower layer | d | e | f |
| Aluminum content × upper layer thickness | — | — | — |
| Evaluation | | | |
| Brilliance | ○ | ◎ | ◎ |
| Color (visual observation) | silver gray | silver gray | silver |
| Reproduction of lower layer color | x | x | x |
| Abrasion test | Δ | Δ | Δ |
| Impact durability | Δ | Δ | Δ |

As is evident from the results shown in Tables 3 to 5, the marking methods used in Examples, in which the content of aluminum powder relative to the upper layer ink medium solids is related to the thickness of the upper layer so as to satisfy the specific inequality, produce printed portions having excellent brilliance and satisfactory sharpness and reproduction of black color. In contrast, the marking methods used in Comparative Examples, in which the content of aluminum powder relative to the upper layer ink medium solids is not adequately related to the thickness of the upper layer or in which the marking layer is not divided into upper and lower layers, fail to provide brilliance or effectively reproduce the black color.

What is claimed is:

1. A golf ball marking method of marking the surface of a golf ball with a character, pattern or the like by a direct or indirect printing technique, characterized by the steps of:

applying a marking layer onto the ball surface for marking, the marking layer being of a two-layer structure consisting of a lower layer of a composition containing a color pigment in a lower layer ink medium and an upper layer which is formed on the lower layer from a composition containing a metal powder in an upper layer ink medium and which is transparent or translucent and has brilliance, and adjusting the content of the metal powder and the thickness of the upper layer such that the relation of the content (wt %) of the metal powder relative to the solids of the upper layer ink medium to the thickness (μm) of the upper layer may satisfy the inequality: $1 \leqq$[metal powder content (wt %)]×[upper layer thickness (μm)]$\leqq 10$.

2. The golf ball marking method of claim 1, wherein the character, pattern or the like is marked by a pad printing technique.

3. The golf ball marking method of claim 1, wherein the character, pattern or the like is marked by thermal transfer using a transfer member.

4. The golf ball marking method of claim 3, wherein a mode of printing the character, pattern or the like on the transfer member is silk screen printing.

5. The golf ball marking method of claim 4, wherein the silk screen printing uses a screen having a ruling of 200 to 300 lines.

6. The golf ball marking method of claim 1, wherein the metal powder has an average particle size of up to 20 μm.

7. The golf ball marking method of claim 1, wherein the metal powder is an aluminum powder.

8. The golf ball marking method of claim 3, wherein a mode of printing the character, pattern or the like on the transfer member is gravure printing.

9. A golf ball characterized in that a marking layer is formed on the golf ball surface by the method of claim 1.

* * * * *